United States Patent [19]

Joubert et al.

[11] Patent Number: 4,470,422

[45] Date of Patent: Sep. 11, 1984

[54] CURING OF TOBACCO LEAF

[75] Inventors: Barend C. Joubert, Bera; Jan H. de Lange, Brits, both of South Africa

[73] Assignee: Modsa (Proprietary) Limited, Transvaal, South Africa

[21] Appl. No.: 226,244

[22] Filed: Jan. 19, 1981

[30] Foreign Application Priority Data

Jan. 22, 1980 [ZA] South Africa ..... 80/0358

[51] Int. Cl.[3] ..... A24B 3/12

[52] U.S. Cl. ..... 131/303; 131/302; 432/500

[58] Field of Search ..... 131/240, 302, 303, 304, 131/305; 432/500

[56] References Cited

U.S. PATENT DOCUMENTS 3,503,137 3/1970 Wilson ..... 131/303

4,192,323 3/1980 Horne ..... 131/303

*Primary Examiner*—Vincent Millin

*Attorney, Agent, or Firm*—Lowe, King, Price & Becker

[57] ABSTRACT

A method of, and apparatus for, curing tobacco leaf in a curer barn. Air is caused to circulate through the barn to dry the leaf. The temperature of the air is controlled to maintain a predetermined temperature or humidity difference between upper and lower zones inside the barn, within a predetermined tolerance. The result is that the curing process is optimally controlled by the condition of the leaf itself and independently of ambient conditions.

14 Claims, 3 Drawing Figures

CURING OF TOBACCO LEAF

BACKGROUND OF THE INVENTION

This invention relates to the curing of tobacco leaf.

The temperature and humidity in any type of tobacco curer must be properly controlled if the tobacco leaf is to be cured without spoilage in the minimum of time, with the best possible weight in cured leaf of top quality. The curing process is dependent inter-alia on the humidity and on the temperature inside the curer.

Generally the temperature inside the curer is manually controlled according to empirical formulae. Such processes work satisfactorily but however are not generally optimal. It is impossible to increase the temperature in the curer manually precisely as the leaf requires heat. The result of not being able to set the correct temperature at the correct time results in scorching or early dehydration of the leaf, or in loss of weight.

Various solutions have been proposed and described in the literature, see the specifications of U.S. Pat. Nos. 3,503,137; 3,545,455; 3,618,225; 3,624,917; 3,664,034; 3,927,683; 3,937,227; 4,178,946; 4,192,323, and 4,206,554.

The second last of these patents discloses a method for bulk curing tobacco in which the temperature conditions in a curing barn are automatically controlled by heating the air being circulated through the barn in a controlled manner to maintain a predetermined difference in the dry bulb temperature of the air entering and leaving the curing chamber. To achieve this objective temperature sensors are located externally of the barn exposed to the inlet and outlet air flows respectively. As emerges from the disclosure the actual temperature maintained in the barn is largely dependent on the ambient temperature i.e. the temperature prevailing outside the barn. It follows that the curing process is also dependent on the temperature externally of the barn.

SUMMARY OF THE INVENTION

It is an object of the present invention to provide an improved method of curing tobacco leaf by controlling the temperature accurately in the curer as the leaf requires it.

The invention provides a method of curing tobacco leaf in a curer barn which includes the steps of supplying conditioned air to the curer barn so as to maintain, between an upper zone and a lower zone inside the curer barn, a first differential of a physical characteristic which is responsive to the curing process.

Further according to the invention the first differential is maintained for a first period which substantially corresponds to the period for colouring the leaf.

The method includes the further step after the first period of maintaining a second differential of the physical characteristic for a second period which substantially corresponds to the period for drying the leaf.

In order to avoid shock effects to the leaf i.e. scalding or excessive drying of the leaf when the first differential is changed to the second differential the method includes the step of effecting a gradual change of the first differential to the second differential between the first and second periods.

The physical characteristic may be the humidity level prevailing inside the curer barn.

Alternatively the physical characteristic is the temperature prevailing inside the curer barn.

Either basis i.e. humidity or temperature, functions satisfactorily in that the curing process is dependent on the state of the leaf and on the conditions prevailing inside the barn and is not influenced by the ambient conditions i.e. the humidity or temperature outside the barn. This has the advantage that the curing proceeds in a controlled and substantially predetermined manner and rate and is not subject to the vagaries of the weather.

In the temperature based system the first differential is of the order of 7½° C. and the second differential is from 10° C. to 20° C. and is adjustable.

The invention also provides tobacco curing apparatus which comprises a curer barn, means for generating a first signal which is dependent on the level of a physical characteristic prevailing in an upper zone inside the curer barn, the physical characteristic being responsive to the curing process, means for generating a second signal which is dependent on the level of the physical characteristic prevailing in a lower zone inside the curer barn, means for comparing the first and second signals and for generating a control signal which is dependent on the first and second signals, and means for utilizing the control signal to maintain a predetermined difference in the levels of the physical characteristic prevailing in the upper and lower zones respectively.

Further according to the invention the means for utilizing the control signal controls the flow of conditioned air into the curer barn.

The first and second signal generating means may include sensors which are either temperature or humidity dependent.

BRIEF DESCRIPTION OF THE DRAWINGS

The invention is further described by way of example with reference to the accompanying drawings in which.

DESCRIPTION OF A PREFERRED EMBODIMENT

Figure 1:
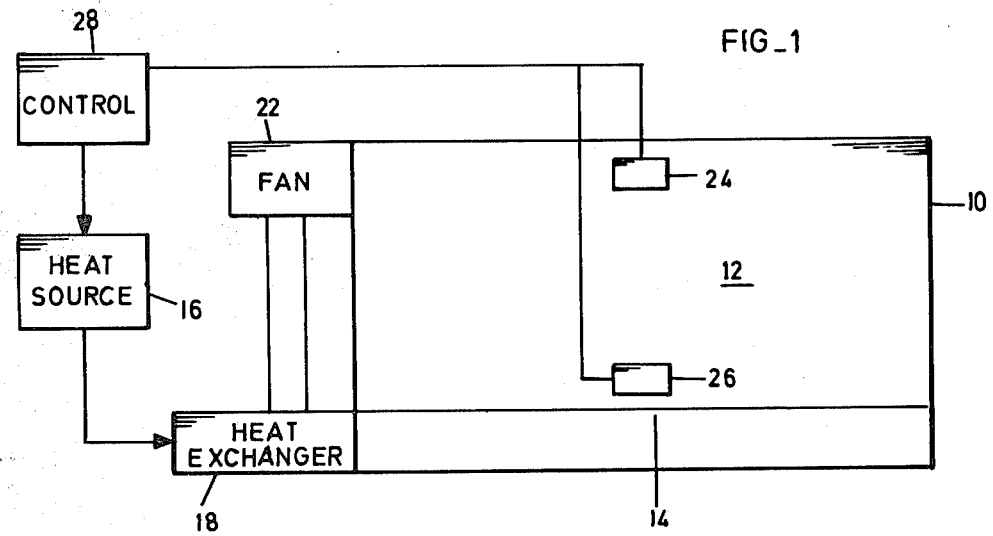
FIG. 1 is a schematic view of a curer barn with temperature control apparatus according to the invention.

FIG. 1 illustrates a housing 10 which defines a curer barn 12 and which has a false floor 14.

Equipment which is ancillary to the curer barn includes a heat source 16, for example an automatic stoker or a burner, an optional heat exchanger 18 and a fan 22. A temperature probe 24 is located in an upper zone inside the curer barn and a second temperature probe 26 is located in a lower zone inside the curer barn. The two probes generate electrical signals at amplitudes which are proportional to the respective temperatures in the zones, and the electrical signals are applied to a controller 28.

Figure 2:
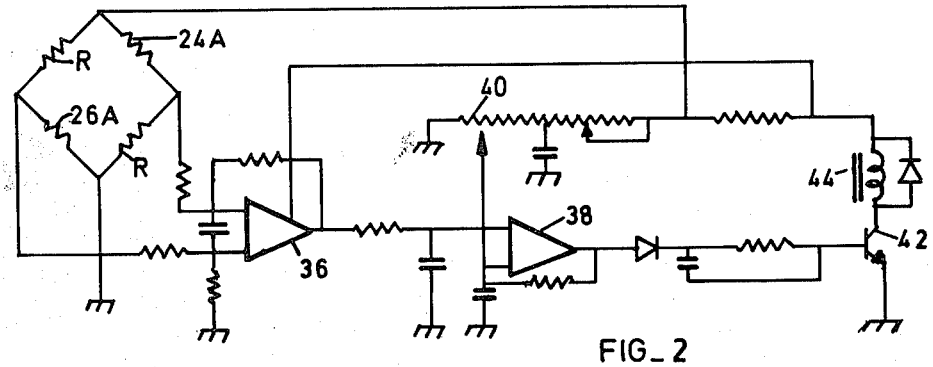
FIG. 2 is a circuit diagram of the temperature control apparatus of FIG. 1.

FIG. 2 illustrates a circuit diagram of the controller 28. Platinum temperature dependent resistors 24A and 26A respectively are used for the probes and these are connected with resistors R, in a bridge configuration. The currents passed by the resistors 24A and 26A are proportional to the temperatures in the upper and lower zones and the voltages across the resistors are therefore proportional to the temperatures. The output voltages of the bridge are applied to a differential 36 and the output of this amplifier is applied to an inverting input of a comparator 38. The positive terminal of the comparator is connected to an adjustable voltage source 40. The output of the comparator 38 drives a power transistor 42 which is connected in series with a relay coil 44.

Figure 3:
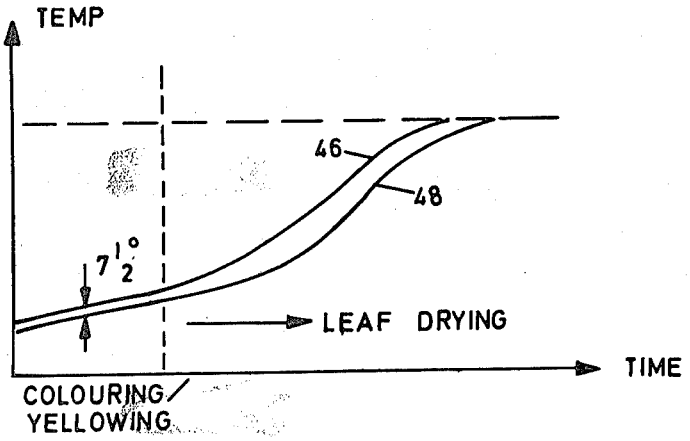
FIG. 3 is a graph of temperature versus time inside the curer barn.

FIG. 3 illustrates a graph of temperature versus time within the curer barn. The graph has an upper curve 46 which illustrates the variation with time of the temperature of the lower probe 26, and a lower curve 48 which illustrates the variations with time of the temperature of the upper probe 24.

The tobacco leaf is loaded into the curer barn with maximum moisture and is tightly packed in frames between the upper and lower zone probes. A barn of average size when filled with good quality tobacco leaf can easily hold up to 10000 liters of water.

When the tobacco leaf is placed in the barn the voltage source 40 is adjusted to maintain the temperature differential between the two probes 24 and 26 at approximately $7\frac{1}{2}$° C. as shown in FIG. 3.

This is achieved in the following way. The signals produced by the two probes 24 and 26 are applied to the amplifier 36 which develops an output signal that is a function of the difference between the two probe signals. The voltage of the output signal of the amplifier 36 is compared to the voltage of the source 40 in comparator 38. Depending on the relationship of these two voltages the output signal of the comparator 38 is either high or low and the coil 44 is either not energized or energized through the transistor 42. The contacts of the coil 44 control a contactor of the heat source 16 which is in series with a high limit thermostat or humidistat (not shown).

When heat is called for by the control circuit the contactor is closed and the heat source 16 is turned on. Additional fuel is supplied to the heat source and air which is passed through the heat exchanger 18 by means of the fan 22 is heated to a higher temperature. The hot air is circulated through the barn by means of the fan 22.

The hot air which is blown into the curer barn through the floor 14 rises through, and dries, the leaf in the barn.

As water is evaporated from the leaf and taken up by the air the temperature of the air drops and a temperature differential is established between the upper and lower probes. If the temperature of the air in the lower zone is too high then the differential increases. As the differential is dependent on the evaporation rate of the leaf a high differential indicates that the drying process is too rapid. Conversely a low differential is indicative of a low evaporation rate i.e. that the drying process should be accelerated.

The control circuit functions to maintain the differential at a value which has been empirically determined as being optimal, depending on the stage of the curing. However, the differential control is not an absolute temperature difference imposed on the curer barn regardless of the qualities of the leaf to be cured. The differential control is inherently dependent on the humidity level in the curer barn, and this is dependent on the moisture content of the leaf, the evaporation rate of the leaf, and the temperature of the air introduced into the lower zone.

It follows that the system is one which is dependent on an empirically determined temperature differential but that the control function is automatically adapted to the qualities of the leaf to be cured.

Further, since the temperature sensors are located inside the curer barn the control function is independent of the ambient conditions i.e. temperature and humidity outside the barn. The control function is therefore more precise and efficient.

The initial temperature differential of approximately $7\frac{1}{2}$° C. is maintained until the leaves have been properly coloured. Thereafter as shown in FIG. 3 the voltage source 40 is adjusted so as to maintain a greater maximum temperature differential between the two probes. The second temperature differential is determined empirically but generally is of the order of from 10° C. to 20° C. The circuit functions in precisely the same way but in this case as the leaves are drying more uniformly throughout the curer barn a greater quantity of heat is called for by the curer in order to maintain the temperature differential between the two probes. Consequently the average temperature inside the curer increases gradually to a maximum of 75° C. which is determined by means of the high limit thermostat. Eventually the temperatures in the upper and lower zones of the curer are approximately the same and the two curves 46 and 48 meet. At this stage the leaves are completely dried.

An important aspect of the invention concerns the transition between the yellowing and drying stages i.e. the increase of the differential. In accordance with the invention this is effected gradually, at a rate of between $\frac{1}{2}$° C. to $1\frac{1}{2}$° C. per hour, by manually adjusting the control of the variable voltage source 40. This ensures that the leaf is not "shocked" or scalded by an abrupt temperature increase and insures that the final product is a high quality leaf.

In the method of the invention the leaf itself determines the rate at which the temperatures in the curer barn advances. The upper zone probe acts like a wet bulb because of the evaporation of water from the leaf which cools it down. The resulting slow advance in temperature cannot be emulated manually.

On colouring of tobacco, although the air in the curer barn is circulated, no intake of fresh air, or exhausting of air, takes place, and the humidity is approximately 90% RH. When the temperature, and consequently the humidity, increases, a humidistat causes a vent to be opened and fresh air is drawn into the curer barn, and moisture is expelled from it. The humidity is thereby reduced. As the moisture is reduced in the barn and expelled through the outlet ventilators, the temperature of the upper probe rises and the lower probe follows the upper probe. This is the method of increasing the temperature in the curer.

The advantage of the invention lies in the fact that the control equipment maintains the temperature in the curer barn at an optimal value which ensures minimum curing time without spoilage and maximum weight and best quality leaf. The reduced curing time in turn reduces the fuel demand of the burner.

For example a curer barn fitted with the control equipment of the invention required approximately $21\times10^6$ BTU's and cured ripe tobacco in 5 days. Previously, with conventional curing control equipment, the curing time was 7 to 8 days and $36\times10^6$ BTU's were required.

In addition to the general principles of the invention described thusfar there are two important elements which must be taken into account of during the curing process. The first is that during the yellowing stage the temperature inside the curer barn should not exceed a value of from 36° C. to 38° C. If this temperature limit is exceeded the cellular structure of the leaf is destroyed and the quality of the leaf is reduced. The possibility of this happening is avoided by using a temperature sensor which is located inside the curer barn to shut down the heat source if the temperature reaches the preset limit.

This aspect emphasises that the curing process should be independent of ambient conditions. If this is not the case the temperature inside the curing barn fluctuates as the ambient temperature changes and, although the temperature differential may be maintained, it is quite possible for the temperature in the curing barn to exceed the preset limit with a consequent deterioration in the quality of the leaf. Closely related to this aspect is the face that in a system which is dependent on ambient conditions an increase in the external humidity causes a decrease in the internal temperature, and vice versa. Both of these effects can be harmful for, in the former case the leaf in the curer barn which is already dried tends to reabsorb moisture while, in the latter case, if the temperature rise is rapid, the leaf is damaged.

Again it should be pointed out that these possibilities are eliminated in the present invention which provides a system which is independent of ambient conditions, for the curing process is determined by the condition of the leaf itself.

The second important element to be taken account of during the curing process relates to an aspect which has been determined by the applicant through a great deal of experimentation and which is best illustrated by way of an example. Assume that the desired temperature differential is 12° C. and that the temperature of the lower probe is 60° C. with the temperature of the upper probe being 48° C. When the temperature at the lower probe starts dropping below 60° C. the heat source is turned on and warm air enters the curer barn, thereby causing the temperature at the lower probe to increase. In accordance with the invention the heat supply is turned off before the effect of the additional heat manifests itself at the upper probe i.e. before the upper probe temperature can increase. In practice this means that the temperature differential of 12° C. is maintained with a fine tolerance of approximately ¼° C. Over a short interval therefore the upper probe temperature is essentially constant at 48° C. and the lower probe temperatue is between 60° C. and 60¼° C. Eventually though the additional heat manifests itself at the upper probe and the temperature of this probe then increases slightly. The lower probe then follows suit.

If this tolerance is not maintained the temperatures at the two probes increase simultaneously, although not at the same rate, and an unstable condition may result which leads to an excessive temperature rise and consequent leaf damage.

Finally it should be pointed out that the temperature differential, which is determined empirically, is dependent on the desired temperature gradient in the curer barn. For example, if the curer barn holds three layers of tobacco leaf the differential may be fixed at 12° C. However if the barn holds two layers of similar tobacco leaf the differential would be of the order of 8° C. so that the temperature gradiant of approximately 4° C. per layer is maintained.

The invention has been described with reference to a temperature based system. The principles of the invention are however, equally applicable to a humidity based system which in a manner anologous to that described, employs upper and lower humidity sensors. These sensors replace the temperature sensors 24A and 26A but in other respects the principle of operation is unaltered and the same benefits result. This is because the temperature prevailing in a given zone of the barn is dependent on the humidity level in the same zone and this, in turn, is dependent on the moisture in the leaf and the curing rate.

I claim:

1. A method of curing tobacco leaf in a curer barn which includes the step of supplying conditioned air to the curer barn so as to maintain, between an upper zone and a lower zone inside the curer barn, a first differential of a physical characteristic which is responsive to the curing process.

2. A method according to claim 1 wherein the first differential is maintained by repeatedly initiating a variation in the level of the physical characteristic which prevails at one zone and terminating the variation before the level of the physical characteristic which prevails at the other zone alters.

3. A method according to claim 1 wherein the first differential is maintained for a first period which substantially corresponds to the period for colouring the leaf.

4. A method according to claim 3 which includes the further step after the first period of maintaining a second differential of the physical characteristic for a second period which substantially corresponds to the period for drying the leaf.

5. A method according to claim 4 wherein the second differential is maintained by repeatedly initiating a variation in the level of the physical characteristic which prevails at one zone and terminating the variation before the level of the physical characteristic which prevails at the other zone alters.

6. A method according to claim 4 which includes the step of effecting a gradual change of the first differential to the second differential between the first and second periods.

7. A method according to claim 1 wherein the physical characteristic is the humidity level prevailing inside the curer barn.

8. A method according to claim 1 wherein the physical characteristic is the humidity level prevailing inside the curer barn.

9. Tobacco curing apparatus which comprises a curer barn, means for generating a first signal which is dependent on the level of a physical characteristic prevailing in an upper zone inside the curer barn, the physical characteristic being responsive to the curing process, means for generating a second signal which is dependent on the level of the physical characteristic prevailing in a lower zone inside the curer barn, means for comparing the first and second signals and for generating a control signal which is dependent on the first and second signals, and means for utilizing the control signal to maintain a predetermined difference in the levels of the physical characteristic prevailing in the upper and lower zones respectively.

10. Apparatus according to claim 9 wherein the control signal repeatedly initiates a variation in the level of the physical characteristic which prevails at one zone and terminates the variation before the level of the physical characteristic which prevails at the other zone alters.

11. Apparatus according to claim 9 which includes means for adjusting the control signal so as to vary the predetermined difference.

12. Apparatus according to claim 9 in which the means for utilizing the control signal controls the flow of conditioned air into the curer barn.

13. Apparatus according to claim 9 wherein the first and second signal generating means include humidity dependent sensors.

14. Apparatus according to claim 9 wherein the first and second signal generating means include temperature dependent sensors.

* * * * *